US009242166B2

(12) United States Patent
Krafft

(10) Patent No.: US 9,242,166 B2
(45) Date of Patent: Jan. 26, 2016

(54) DEVICE AND ASSEMBLY FOR GLIDING

(71) Applicant: SALOMON S.A.S., Metz-Tessy (FR)

(72) Inventor: Bertrand Krafft, Brison Saint-Innocent (FR)

(73) Assignee: SALOMON S.A.S., Metz-Tessy (FR)

( * ) Notice: Subject to any disclaimer, the term of this patent is extended or adjusted under 35 U.S.C. 154(b) by 93 days.

(21) Appl. No.: 14/050,652

(22) Filed: Oct. 10, 2013

(65) Prior Publication Data

US 2014/0103621 A1 Apr. 17, 2014

(30) Foreign Application Priority Data

Oct. 11, 2012 (FR) ..... 12 02721

(51) Int. Cl.

| | |
|---|---|
| ***A63C 9/02*** | (2012.01) |
| ***A63C 5/02*** | (2006.01) |
| ***A63C 9/00*** | (2012.01) |
| ***A63C 5/07*** | (2006.01) |

(52) U.S. Cl.

CPC .. *A63C 9/002* (2013.01); *A63C 5/07* (2013.01)

(58) Field of Classification Search

CPC ..... A63C 9/06; A63C 9/00; A63C 9/002; A63C 9/005; A63C 9/065; A63C 9/086; A63C 9/24; A63C 11/20

USPC ..... 280/611, 614, 615, 621, 622, 626, 627, 280/631, 632, 633, 634

See application file for complete search history.

(56) References Cited

U.S. PATENT DOCUMENTS

| | | | | | |
|---|---|---|---|---|---|
| 899,963 | A | * | 9/1908 | Ferguson | 280/11.206 |
| 1,964,103 | A | * | 6/1934 | Attenhofer | 280/614 |
| 2,176,226 | A | * | 10/1939 | Reed, Jr. | 280/621 |
| 2,207,986 | A | * | 7/1940 | Keller | 280/621 |
| 2,259,701 | A | * | 10/1941 | Legros | 280/616 |
| 2,308,252 | A | * | 1/1943 | Udall | 280/621 |
| 2,450,514 | A | * | 10/1948 | Humlegard | 280/759 |
| 2,462,281 | A | * | 2/1949 | Piane | 280/619 |
| 2,567,772 | A | * | 9/1951 | Jansen | 280/621 |
| 2,669,459 | A | * | 2/1954 | Fleming | 280/622 |
| 2,933,324 | A | * | 4/1960 | Stimler | 280/637 |
| 3,332,695 | A | * | 7/1967 | Rosenberg | 280/612 |
| 3,481,617 | A | * | 12/1969 | Salomon | 280/637 |
| 3,490,782 | A | * | 1/1970 | Hatlapa | 280/637 |
| 3,514,119 | A | * | 5/1970 | Sutherland | 280/617 |
| 3,897,077 | A | * | 7/1975 | Schweizer | 280/618 |
| 3,913,930 | A | * | 10/1975 | Okonski | 280/637 |
| 3,994,511 | A | * | 11/1976 | Gronseth | 280/614 |
| 4,473,235 | A | | 9/1984 | Burt | |

(Continued)

FOREIGN PATENT DOCUMENTS

| | | | | |
|---|---|---|---|---|
| DE | 3605875 A1 | * | 8/1987 | A63C 9/00 |
| DE | 199 17 960 C1 | | 10/2000 | |

(Continued)

*Primary Examiner* — Paul N Dickson
*Assistant Examiner* — Bridget Avery
(74) *Attorney, Agent, or Firm* — Greenblum & Bernstein, P.L.C.

(57) ABSTRACT

A gliding device includes a gliding board, a mechanism for binding a boot to the gliding board; the binding mechanism including a retaining device allowing rotation of the boot about an axis transverse to the gliding board; and an arrangement for applying a pulling force on the shovel of the gliding board. The arrangement for applying a pulling force on the shovel is not elastic; and the gliding device further includes a device for adjusting the length of the pulling arrangement.

21 Claims, 1 Drawing Sheet

(56) References Cited

U.S. PATENT DOCUMENTS

| | | | | |
|---|---|---|---|---|
| 5,669,622 | A * | 9/1997 | Miller | 280/615 |
| 5,769,444 | A * | 6/1998 | Mason | 280/600 |
| 5,947,507 | A * | 9/1999 | Quintana et al. | 280/615 |
| 9,108,103 | B2 * | 8/2015 | Nobil | A63C 11/20 |
| 2010/0084838 | A1 | 4/2010 | Buercher | |

FOREIGN PATENT DOCUMENTS

| | | | | |
|---|---|---|---|---|
| EP | 0 665 035 | A1 | 8/1995 | |
| FR | 2 928 843 | A1 | 9/2009 | |
| WO | WO-83/02397 | A1 | 7/1983 | |
| WO | WO 2008049993 | A2 * | 5/2008 | A63C 9/0807 |
| WO | WO-2008/110028 | A1 | 9/2008 | |

* cited by examiner

DEVICE AND ASSEMBLY FOR GLIDING

CROSS-REFERENCE TO RELATED APPLICATION

This application is based upon French Patent Application No. 12/02721, filed Oct. 11, 2012, the disclosure of which is hereby incorporated by reference thereto in its entirety, and the priority of which is claimed under 35 U.S.C. §119.

BACKGROUND

1. Field of the Invention

The present invention relates to a gliding device and to a gliding assembly, the latter comprising two such devices adapted to be used together.

The invention relates to skis used in pairs, independently of one another, whereby the skier attaches a ski to each foot, unlike other gliding sports, such as monoskiing or snowboarding, which require both feet of the skier to be attached to the same gliding board.

The invention relates to the fields of ski touring or cross-country skiing, in which the front of the boot pivots to enable heel elevation above the ski in order to reproduce the walking motion, while allowing the ski to glide continuously on the snow.

2. Background Information

The document DE-199 17 960-C1 discloses a gliding device comprising a cross-country ski, as well as an elastic band connecting the tip of the ski to the boot in the area of the ankle. During use of such a gliding device, the elastic band is pulled tight and stores energy whenever the user rests his/her heel on the gliding board, such energy then being restored when the user lifts the heel. In this way, the elastic band assists the skier by facilitating the raising of the heel by means of the energy stored in the elastic band.

The elastic band is difficult to implement, as it requires finding a compromise in a stiffness that is adequately substantial to store energy and sufficiently low to enable the heel to be raised and lowered. In addition, adjusting the length of the elastic band as a function of the weight of the skier is tricky. This system has a limited useful life, especially for low temperatures. Moreover, this device does not take advantage of the energy generated by the deformation of the ski shovel which bends when the skier's heel rests on the ski.

Furthermore, in order to be used, whether uphill or download, such a device requires conventional alpine ski boots, that is to say boots comprising rear support structures. Rear support structures in a ski boot are adapted to prevent the skier from tilting backward. These structure are mechanical and, given the significant forces that can be involved during skiing, they are bulky and heavy, and they also considerably hinder forward bending.

SUMMARY

The present invention overcomes the aforementioned drawbacks by providing a gliding device that assists the skier in moving forward, is easy to set and adjust, has a satisfactory useful life, and makes it possible to use the energy generated by the deformation of the gliding board. The invention also facilitates skiing with lighter and more flexible equipment, especially with respect to the boots.

To this end, the invention provides a gliding device comprising a gliding board, a mechanism for binding a boot on the gliding board, the binding mechanism comprising a retaining device allowing rotation of the boot about an axis transverse to the gliding board, an arrangement for pulling a shovel of the gliding board, as well as fastening mechanism connecting the pulling arrangement to the boot of the user. The pulling arrangement of the gliding device is elastic and the gliding device further comprises a device for adjusting the length of the pulling arrangement.

Due to the invention, when the skier's heel rests on the gliding board, the fastening mechanism connecting the pulling arrangement to the boot have the effect of raising the shovel of the ski, and when the skier lifts his/her heel, the shovel of the gliding board is released and moves downward, pushing the boot forward, thereby helping the skier to advance. In addition, the band/linkage is easy to adjust as a function of the weight of the skier, by simply adjusting its length.

According to advantageous but not essential aspects of the invention, a device of this type may incorporate one or more of the following features, taken in any technically feasible combination:

- the pulling means are comprised of a linkage, such as a band or formed by a cord or a wire cable;
- a central zone of the gliding board is cambered when no external mechanical action is exerted on the gliding board, and the camber decreases when the weight of the skier rests on the gliding board;
- the pulling arrangement is attached in the area of the front end of the gliding board;
- the fastening mechanism is comprised of a strap, e.g., attached to the boot in the area of the lower leg or ankle of the user;
- the device comprises at least one pulley cooperating with the pulling arrangement to form a reeving arrangement;
- the pulley is located in the vicinity of the front end of the gliding board;
- a guide for the pulling arrangement is attached to the gliding board in front of the retaining device;
- the adjusting device allows the length of the pulling arrangement to be sufficiently short to enable the pulling arrangement to maintain a heel of the boot above the gliding board, especially when all the skier's weight tends to press the boot against the gliding board;
- the device comprises a removable strap for fastening the pulling arrangement to the boot, around the ankle.

The invention also provides a gliding assembly comprising two gliding devices adapted to be used together.

BRIEF DESCRIPTION OF DRAWINGS

An understanding of the invention will be enhanced and other advantages of the invention will appear more readily apparent in the light of the following description of a gliding device according to the invention, given only by way of example, and with reference to the annexed drawings, in which.

DETAILED DESCRIPTION

Figure 1:
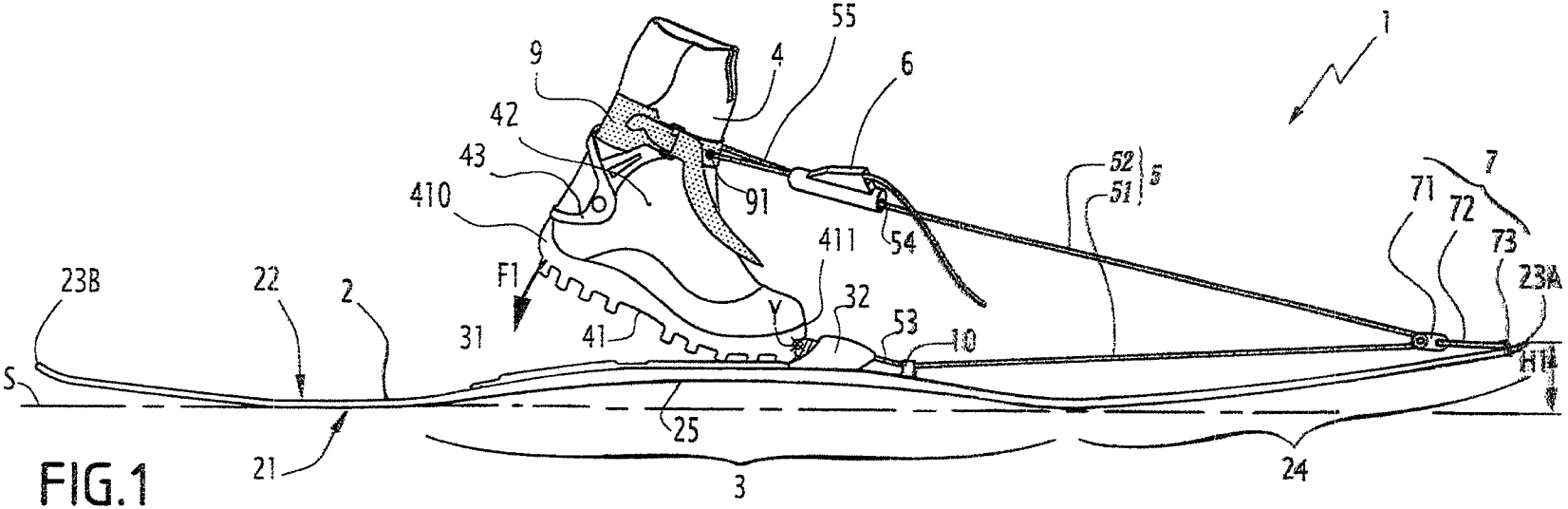
FIG. 1 is a side view of a gliding device, in a first position in which the heel of a skier's boot is raised.
Figure 2:
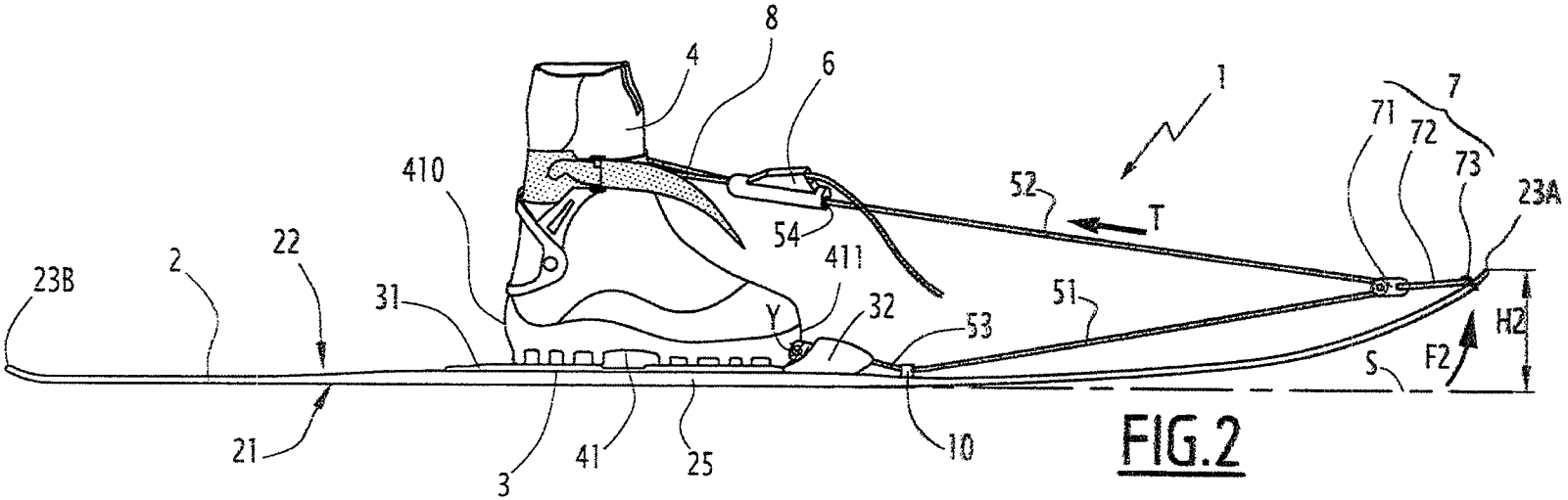
FIG. 2 is a side view of the gliding device of FIG. 1, in a second position in which the heel of a skier's boot rests flat on the gliding board.

FIGS. 1 and 2 show a gliding device 1 comprising a gliding board 2. In this case, the gliding board is a cross-country ski, for intermediate practice between Nordic skiing and ski touring.

The gliding device 1 is used concurrently with a second, identical gliding device 1, and the skier has each foot connected independently to a respective ski 2.

The ski 2 comprises a gliding surface, or sole 21, adapted to come into contact with the snow, as well as an upper surface 22 opposite the sole 21. The ski 2 extends longitudinally between a front end 23A and a rear end 23B. The structure of the ski 2 is such that a front portion 24 of the ski, that is, the shovel, is naturally raised when no external mechanical action is applied to the gliding device 1.

A binding mechanism 3 for binding a boot 4 is attached to the ski 2 in the area of a central zone 25 of the upper surface 22. The binding mechanism 3 comprises a base 31 on which a sole 41 of the boot 4 rests, and a front retaining device 32 which makes it possible to fasten a front end 411 of the sole 41 of the boot 4, while allowing rotation of the boot 4 about a transverse axis Y perpendicular to the longitudinal direction of the ski 2. The retaining device 32 enables the heel 410 of the boot 4 to be raised and lowered in relation to the ski 2.

A pulling arrangement, in the form of a non-elastic band 5, such as a flat band, in the illustrated embodiment, connects the boot 4 to the ski 2. The term "non-elastic" in this context refers to there being little or no variation (or substantially no variation) in the length of the band 5 when a tensile force is applied thereto. For example, one can consider that a band is non-elastic if its length does not vary by more than 4% upon application thereto of a tensile force of 80 N. The band 5 is comprised, for example, of a cord or a metal rope or cable.

The band 5 includes a fixed end 53, or first end region, that is removably attached to the retaining device 32. The other end 54 of the band 5, or second end region, is movable (or adjustable) and is attached to the boot 4 in the area of the ankle. The median portion of the band 5 is attached in the area of the front end 23A of the ski 2 by means of an assembly device 7 including a pulley 71 (or band reversing or direction-changing guide) which cooperates with the band 5, so as to form a reeving arrangement. The band 5 thus includes a first portion 51 extending between its fixed end 53 and the pulley 71, as well as a second portion 52 extending between the pulley 71 and the boot 4.

The assembly device 7 also includes a connecting element 72 that connects the pulley 71 to an anchoring element 73 for fastening the assembly device 7 to the ski 2. In the example shown in the figures of the drawing, the connecting element 72 is constituted by a cord, rope, or cable, and the fastening element 73 is formed by a metal piece, for example, fitted around the front end 23A of the ski 2. More specifically, the fastening element 73 is formed by a rigid metal wire, for example, forming a generally rectangular closed contour, having adapted dimensions so as to fit around the front end 23A of the ski 2 in the manner of a fastener for securing a sealskin on a touring ski. Because of the tapered shape of the front end 23A of the ski 2, the fastening element 73 remains blocked in the area of the end 23A when an external force tends to bring it toward the boot 4.

The length of the connecting element 72 is selected such that the pulley 71 is located in the vicinity of the front end 23A, that is to say in the front third of the ski 2, such as in the shovel zone, or in the front 10% of the length of the ski.

The movable end 54 of the band 5 cooperates with a device 6 for adjusting the length of the band 5. For example, the adjusting device 6 is formed by a cam cleat. By length of the band 5 is meant the length between the fixed end 53 of the band 5 and the adjusting device 6.

The fastening mechanism is comprised of a strap 9, removable and adjustable lengthwise, which is attached around the boot 4 in the area of the ankle, and which comprises two eyelets 91 for passage of a fastening element 8 connecting the strap 9 to the adjusting device 6. In the example shown in the drawing figures, the fastening element 8 is formed by a third portion 55 of the band 5, which extends beyond the adjusting device 6 and forms a loop.

Other fastening mechanisms may be used to attach the pulling arrangement to the leg of the user. For example, a hook attached directly to the boot can be used.

An element 10 for guiding the band 5 is attached to the upper surface 22 of the ski 2, in front the retaining device 32. The guiding element 10 presses the first portion 51 of the band 5 against the ski 2. This is a pulley, for example.

In the configuration of FIG. 1, the ski 2 rests on a flat and horizontal surface S. The boot 4 exerts little or no force on the band 5, and the front end 23A of the ski 2 is raised by a non-zero height H1 in relation to the surface S.

When the skier rests his/her heel 410 on the gliding board 2, as indicated by the arrow F1 in FIG. 1, the boot 4 switches to the configuration of FIG. 2, in which it applies a tensile force T on the band 5. The band 5 then pulls on the assembly device 7 such that the front end 23A of the ski 2 is raised, as indicated by the arrow F2 in FIG. 2. Thus, when the boot 4 pulls on the band 5, the height H2 between the front end 23A of the ski 2 and the glide surface S is greater than the height H1 of FIG. 1.

In the configuration of FIG. 2, the shovel 24 of the ski 2 is tensioned, and the shovel is thereby flexurally deformed. Energy is thus stored in the ski 2, which is slightly elastic. Then, when the skier again lifts the heel 410, the tensile force T decreases, thereby enabling the front end 23A of the ski 2 to come back down, releasing the energy stored by the ski 2. Upon release of the stored energy, the ski reassumes its camber and tends to rise. The release of energy also pushes the heel 410 of the boot 4 upwards. All of these effects contribute to reducing the effort required from the skier during the active phase of his/her steps, which assists the skier to advance.

The band 5 is removable and thus enables the ski 2 to be used in a conventional fashion, if the skier so desires, such as when skiing downhill.

The ski 2 is cambered, meaning that in the position of FIG. 1, when no external mechanical action is exerted on the gliding device 1, the central portion 25 of the ski 2 is elevated in relation to the surface S.

The sole 21 of the ski 2 is generally provided with reliefs, i.e., projections, or with a removable sealskin that increases the gripping ability of the ski 2 on the snow or other terrain. In the position of FIG. 2, when the skier's weight is supported on the ski 2, the central portion of the ski 2 is in contact with the surface S. In this way, the pressure of the sole 21 of the ski 2 is more substantial, which provides a better grip of the ski 2 on the snow, especially when skiing uphill.

Compressing the central portion of the ski 2 makes it possible to store energy in the ski 2, as it is slightly elastic. When the skier starts to raise his/her heel, the central portion 25 of the ski 2 rises, thereby releasing the stored energy and generating a vertical impulse directed slightly forward. The ski 2 is then released from the grip to which it was subject when the sole 21 was pressed flat on the surface S. This release occurs without requiring any additional effort from the skier. As the skier continues to raise his/her heel, the stored energy continues to be restored, which facilitates the progress of the skier.

Due to the reeving arrangement provided by the assembly device 7, the tensile force T applied to the ski 2 by the skier is doubled, which increases the stored energy. Alternatively, the band 5 comprises a plurality of reeving arrangements, or does not have any.

The adjusting mechanism 6 make it possible to easily adjust the intensity of the tensile force T, especially depending upon the weight of the skier, without having to disassemble the gliding device 1. It is also possible to relax the band 5 until it no longer exerts a tensile force T, which allows switching to a conventional gliding sport or practice without removing the band 5. Furthermore, in the ascent phase, adjusting the length of the band 5 also makes it possible to adjust the height H1, which allows adapting the height H1 as a function of the reliefs or contour of the terrain or the height of the snow. Also, depending upon the stiffness of the ski, an adequate reduction in the length of the band 5 can result in preventing the heel 410 from contacting the ski, even at the end of its downward movement in the direction F1. In this way, the adjusting mechanism can be regarded as a band shortener. Thus, the pulling arrangement acts as a climbing aid, that is to say, this arrangement maintains the heel at a certain height in its movement in the direction F1.

During the descent phase, the skier himself/herself maintains the heel on the ski. In this phase, the pulling arrangement prevents the skier's leg from tilting backward. Thus, the pulling arrangement serves as rear support structure. Advantageously, the gliding assembly according to the invention can be used with a much more flexible and lighter boot than ski boots that are typically used for skiing. For example, the boot 4 shown is a boot having a flexible upper 42, simply equipped with a light collar 43 that does not offer a rear support as strong as that which is typically provided in alpine ski boots, i.e., for an alpine skier.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A gliding device comprising:

a gliding board extending longitudinally, the gliding board including a shovel;

a binding mechanism for binding a user's boot on the gliding board, the binding mechanism comprising a boot-retaining device structured and arranged to allow rotation of the boot about an axis transverse to the longitudinally extending gliding board between a raised position in relation to the gliding board and a lowered position in relation to the gliding board;

a non-elastic pulling arrangement extending to the shovel of the gliding board and designed to pull the shovel of the gliding board;

a removable boot-engaging fastening mechanism to fix the pulling arrangement to the user's boot and thereby have a tensile force applied between the user's boot and the shovel of the gliding device;

a length-adjusting device designed to adjust a length of the pulling arrangement between the user's boot and the shovel of the gliding board.

2. A gliding device according to claim 1, wherein:

the pulling arrangement comprises a band.

3. A gliding device according to claim 1, wherein:

the pulling arrangement comprises a cord or rope.

4. A gliding device according to claim 1, wherein:

the pulling arrangement comprises a metal cable.

5. A gliding device according to one of claim 1, wherein:

a central zone of the gliding board is cambered in a first configuration when no external mechanical action is exerted on the gliding board;

the camber is decreased in a second configuration when the boot is in the lowered position and the user's weight rests on the gliding board.

6. A gliding device according to claim 1, wherein:

the pulling arrangement is attached to an area of a front end of the gliding board.

7. A gliding device according to claim 1, further comprising:

at least one pulley cooperating with the pulling arrangement to form a reeving arrangement.

8. A gliding device according to claim 1, further comprising:

a mechanism for guiding the pulling arrangement is fixed to the gliding board forward of the boot-retaining device.

9. A gliding device according to claim 1, wherein:

the removable boot-engaging fastening mechanism comprises a removable strap designed to fasten the pulling arrangement to the boot around an ankle of the user.

10. A gliding device according to claim 1, wherein:

the gliding board is one of a paired set of two gliding boards, said one of the paired set being structured and arranged for use with a first of a left foot and right foot of the user and another of the paired set being structured and arranged for use with a second of the left foot and right foot of the user.

11. A gliding device according to claim 1, wherein:

the gliding board is a cross-country ski; and the boot-retaining device is a cross-country binding designed to connect a front of the boot to the cross-country ski for facilitating said rotation of the boot.

12. A gliding assembly comprising:

a first gliding device according to claim 1; and a second gliding device;

the first and second gliding devices being structured and arranged to be used by the user together.

13. A gliding device according to claim 7, wherein:

the pulling arrangement is attached to an area of a front end of the gliding board;

the at least one pulley is located in the area of the front end of the gliding board.

14. A gliding device according to claim 2 wherein:

the length-adjusting device is a band shortener designed to reduce a length of the band to enable the pulling arrangement to maintain a heel of the boot above the gliding board in the boot-lowered position in relation to the gliding board.

15. A gliding sports device comprising:

a gliding board designed to support at least one boot of a user, the gliding board extending longitudinally and having a shovel;

a binding designed to bind the user's boot on the gliding board, the binding comprising a boot-retaining device designed to fix a front of the user's boot in relation to the gliding board while allowing rotation of the boot about an axis transverse to the longitudinally extending gliding board between a raised position in relation to the gliding board and a lowered position in relation to the gliding board;

a non-elastic band designed to be secured to the shovel of the gliding device and designed to extend between the shovel and the user's boot;

a removable boot-engaging fastening mechanism to fix the band to the user's boot and to establish a tensile force between the user's boot and the shovel of the gliding device;

a band-length-adjusting device designed to adjust a length of the band between the user's boot and the shovel of the gliding board.

16. A gliding sports device according to claim 15, wherein: the band is a cord or a rope or a cable.

17. A gliding sports device according to claim 15, wherein: the band is secured to a front end of the gliding board.

18. A gliding sports device according to claim 15, wherein: the band-length-adjusting device is a band shortener designed to reduce a length of the band to enable the pulling arrangement to maintain a heel of the boot above the gliding board in the boot-lowered position in relation to the gliding board.

19. A gliding sports device according to claim 18, wherein: the band shortener comprises a cam cleat.

20. A gliding sports device according to claim 15, further comprising:

a pulley secured in relation to the shovel of the gliding board;

the band includes a first portion, a second portion, and an intermediate portion;

the intermediate portion of the band extends around the pulley;

the first portion of the band extends from the intermediate portion to the binding; and the second portion of the band extends from the intermediate portion to the user's boot.

21. A gliding sports device according to claim 15, wherein: the removable boot-engaging fastening mechanism comprises a removable ankle strap designed to fix the band to an ankle area of the user's boot.

* * * * *